United States Patent [19]

Williamson

[11] Patent Number: 5,042,474

[45] Date of Patent: Aug. 27, 1991

[54] SELF-CONTAINED CLEAN ROOM RESPIRATION SYSTEM WITH BREATHED AIR EXHAUSTING

[76] Inventor: Ian M. Williamson, 555 N. Harbor Dr., Redondo Beach, Calif. 90277

[21] Appl. No.: 509,354

[22] Filed: Apr. 16, 1990

[51] Int. Cl.[5] ..... A62B 7/10

[52] U.S. Cl. ..... 128/206.12; 128/201.29; 128/201.25; 128/201.24; 128/205.29; 55/DIG. 35; 2/DIG. 7

[58] Field of Search ..... 128/201.29, 201.25, 128/201.23, 202.19, 206.12, 204.23, 205.29, 201.24, 863; 55/385.1, DIG. 30, DIG. 35; 2/DIG. 7, 114

[56] References Cited

U.S. PATENT DOCUMENTS

| | | | |
|---|---|---|---|
| 1,113,675 | 10/1914 | Morgan | 128/201.25 |
| 3,736,927 | 6/1973 | Misaqi | 128/201.25 |
| 3,868,728 | 3/1975 | Krzewinski | 2/114 |
| 3,955,570 | 5/1976 | Hutter, III | 2/DIG. 7 X |
| 4,019,508 | 4/1977 | Der Estephanian | 128/202.19 |
| 4,022,550 | 5/1977 | Brink et al. | 417/234 |
| 4,055,173 | 10/1977 | Knab | 2/DIG. 7 X |
| 4,549,542 | 10/1985 | Chien | 128/201.24 |
| 4,590,951 | 5/1986 | O'Connor | 128/204.23 |
| 4,651,727 | 3/1987 | Howorth | 128/201.23 |
| 4,736,467 | 4/1988 | Schwarze et al. | 2/114 |
| 4,871,922 | 10/1989 | Heinrich et al. | 290/1 B |
| 4,901,716 | 2/1990 | Stackhouse | 128/201.25 |
| 4,942,987 | 7/1990 | Stackhouse | 2/114 |
| 5,009,225 | 4/1991 | Vrabel | 128/201.24 |

FOREIGN PATENT DOCUMENTS

| | | | |
|---|---|---|---|
| 1087906 | 8/1960 | Fed. Rep. of Germany | 55/385.1 |

OTHER PUBLICATIONS

U.S. Stat. Inv. Registration H805; Schriver et al; "Exhalation Duct", Aug. 7, 1990; Filed 9/18/89.

*Primary Examiner*—Edgar S. Burr
*Assistant Examiner*—Eric P. Raciti
*Attorney, Agent, or Firm*—Singer & Singer

[57] ABSTRACT

There is described an improved Clean Room System for use with a sterile surgical garment which includes a helmet having an inlet port and an exhaust port. Connected to the inlet port is a portable and mobile pressure filtering system for suppling filtered air to the helmet. A separate portable and mobile vacuum filtering system is connected to the outlet port on the helmet for exhausting and filtering all air removed from the interior of said helmet before exhausting the air into the atmosphere. An exhaust flexible duct is connected at one end to the vacuum filtering system and the other end is extended to a point below the hem of the sterile surgical garment but above the level of the floor. All air fed to the helmet is filtered and all air exhausted from the helmet is filtered and directed away from the confines of the garment thereby preventing reinhalation of the exhausted air and precluding oxygen deprivation to the user.

3 Claims, 2 Drawing Sheets

SELF-CONTAINED CLEAN ROOM RESPIRATION SYSTEM WITH BREATHED AIR EXHAUSTING

This invention relates to portable and mobile apparatus used by persons such as doctors located in an operating room working in a clean room environment, and more particularly to helmet systems in which the user is protected from contaminated air in the environment while at the same time, the patient is protected from contaminated air being exhausted from the user's helmet.

The concept of providing a clean room environment for a doctor to operate in has long been recognized by the prior art as a means of protecting the patient from nosocomial infections.

The concept of a clean room has also been recognized by industry, and specifically in the Space Field and Micro Miniature Field where it has been found necessary to provide a clean room environment for the assembly and manufacture of critical parts such as microelectronic assemblies and gimbals for bearings where contamination caused by external particulates could destroy the equipment being manufactured and assembled.

In the recent past, operating room personnel have become very concerned with the possibility of themselves being contaminated with viruses carried by the patients that are being operated upon. The problem arises when the operating personnel use surgical instruments that create aerosols or smoke when treating a patient who may or may not have an AIDS virus or other highly communicable disease. The intense heat generated by the surgical instrument literally explodes the cells containing the objectionable virus, which are disbursed as an aerosol into the operating room and in the vicinity of the operating personnel.

Therefore the need has arisen not only for a system that would protect the environment and the patient from external contamination possibly supplied by those located in the clean room, but also to protect personnel from particulates existing in the operating room environment that may be generated as a result of procedures being used or materials generated in the clean room itself.

A review of the prior art shows many systems for protecting either the user or the environment, but in no case has there been discovered a system that protects both the user and the environment and where the system is completely mobile and portable for allowing the user to move freely about without being tied to external devices.

For example, U.S. Pat. No. 4,502,480 discloses a helmet system used in combination with a filter to protect the user from breathing contaminated air. Unfortunately there is nothing shown in the system to protect the environment from air being exhaled by the user.

Referring now to U.S. Pat. No. 4,019,508 there is shown an early version of a self-contained system for use by operating room personnel which purports to filter air emanating from the user into the environment thereby protecting the environment from the user's exhaust air. The disclosed system unfortunately only shows how the environment is protected from air that is normally exhausted by the wearer during surgery. There is nothing disclosed to show how the wearer is protected from air that is being breathed from the environment.

Some very early prior art devices attempted to exhaust the air exhaled by the user to filtering devices located external the user. These devices used umbilical hoses or other tubed devices and were not portable or mobile. These devices also only protected the environment and did not protect the user. Such units were not successful since they were not self-contained and they prohibited the user from moving about freely. Examples of such system are U.S. Pat. No. 3,058,463 and 3,955,570.

In patent application serial number 07/219,220 entitled A Clean Room Helmet System and assigned to the same common assignee as the present invention, there is described a truly portable and mobile filtering system in which the helmet is sealed to prevent unfiltered ambient air from entering the helmet. A portable and mobile pressure vacuum system delivers filtered ambient air into an inlet port associated with the helmet worn by the user. A separate portable and mobile vacuum system also worn by the user is connected to an exhaust port associated with the helmet worn by the user and exhausts and filters all air from the helmet before returning the filtered air to the clean room environment.

The preferred embodiment discloses a helmet having a solid transparent face plate having an inlet port on one side and an outlet port on the other side which is adapted to be worn by the user A portable and mobile pressure filtering system adapted to be carried by the person of the user is connected to the inlet port on said helmet for supplying filtered air to the helmet through the inlet port. The pressure filtering system consists of an electric motor/blower, a battery pack and a filtering element connected in circuit to filter all air supplied to said helmet to be breathed by the user.

A separate portable and mobile vacuum filtering system also adapted to be carried on the person of the user is connected to the outlet port on said helmet for exhausting and filtering all air removed from the interior of said helmet through the exhaust port. The vacuum filtering system consists of an electric motor/blower, battery pack and a filtering element connected in circuit to filter all air removed from the helmet. In all other respects, the vacuum filtering system and the pressure filtering system are identical.

In order to improve the efficiency of the helmet system, an air deflector is located in the helmet between the inlet port and the exhaust port for deflecting the filtered incoming air from the inlet port into the vicinity of the user's nose portion, thereby providing optimum breathing efficiency before the air in the helmet is exhausted through the exhaust port. It is recognized however, that other techniques can be used to separate the incoming air from the exhaust air in the helmet. For example, the input air can be supplied from the top of the helmet and exhausted from the bottom.

The Clean Room Helmet System described allows the user to always breath filtered air while operating within the clean room environment and at the same time, ensures that only filtered air will be exhausted into the clean room thereby ensuring that the clean room will not be contaminated by any particulates or viable micro organisms being exhausted from the user's helmet.

In the medical field, it is most important to protect the patient in the operating room from infection during high risk procedures from bacteria and other microorganisms that may be brought in on the garments of the doctor and other operating room personnel. To alleviate this, all personnel in the operating room environment are required to be completely covered by a suitable surgical gown that has been previously sterilized.

The sterilized gowns are necessary, not only to protect the patient, but also to protect the doctor and operating room personnel from exposure to viruses and other microorganisms from an infected patient.

Copending patent application Ser. No. 329,188 entitled Sterile Garment and assigned to the same common assignee describes a suitable garment to be worn by operating room personal. The gown will not be contaminated during the process of being opened and placed on the user. Unfortunately, when the gown is placed over the inlet and exhaust ports of the vacuum and pressure filtering systems, a recirculation of exhaled air into the intake system takes place, thereby depriving the user of required oxygen, thereby making the system unusable.

In the present invention a flexible extension duct is attached at one end to the exhaust filter of the exhaust motor/blower filtering system. The other end of the flexible duct is allowed to hang to a position below the hem of the sterile gown but above the floor. In this way the exhaust air from the helmet is not trapped within the confines of the gown but is allowed to exhaust directly into the clean room floor without affecting the sterility of the gown or the doctor.

Further objects of the invention will be made more apparent by referring now to the accompanying drawings wherein.

Figure 1:
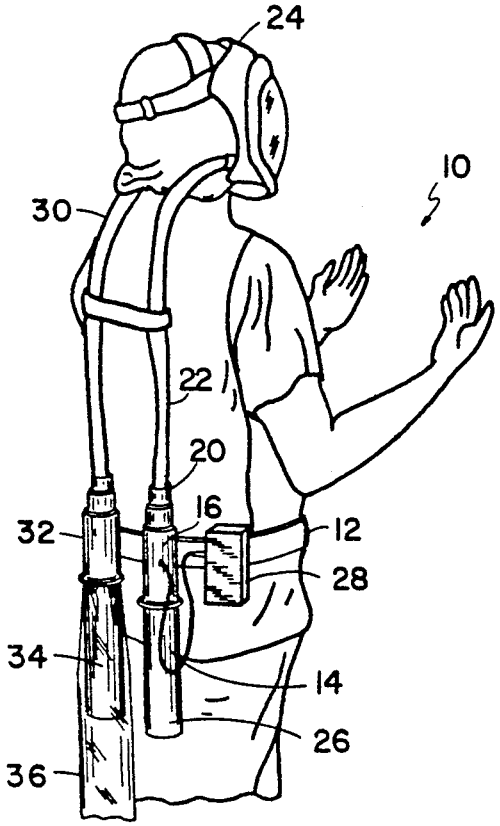
FIG. 1 illustrates the helmet pressure and vacuum filtering system worn by the doctor before the sterile garment is worn.

Referring now to FIG. 1 there is shown a doctor 10 in the process of being suited up for the operating room environment. Located on a belt 12 is a motor/blower pressure filtering system 14 comprising a motor portion 16 connected at one end 20 to a hose 22 connected to one side of a helmet 24. The other end of the motor 16 is connected to a filter 26 thereby allowing air to be drawn into the filter, through the motor 16 and out the hose 22 and into the helmet 24. A portable battery pack 28 is also connected to the belt 12 on the doctor 10 thereby making the system portable and mobile.

A hose 30 is connected at one end to the helmet 24 and at the other end to an exhaust motor/blower filtering system 32 which is in turn connected to a filter 34. In this way all exhaust air from the helmet 24 is exhausted through hose 30, motor 32 and out filter 34 thereby insuring that all air discharged into the clean room environment will be filtered. Attached to the exhaust filtering motor 34 is a flexible duct 36 adapted to convey the filtered exhaust air away from the confines of the sterile gown. Details of the hose 30 and the connection to the exhaust filtering motor 32 will be explained in connection with FIGS. 4 and 5.

Figure 2:
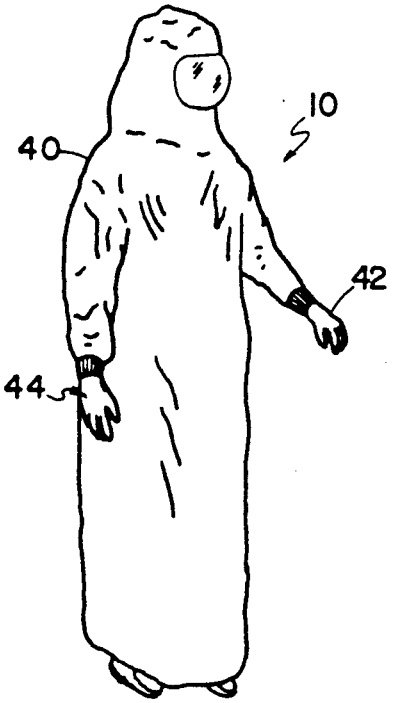
FIG. 2 illustrates a sterile gown completely covering the doctor.
Figure 3:
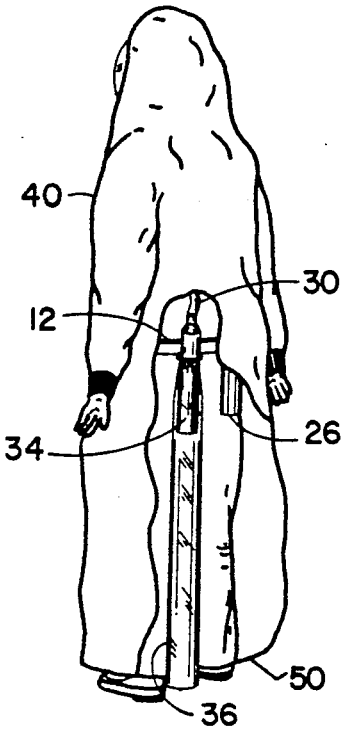
FIG. 3 illustrates the gown of FIG. 2 showing a cutaway portion in the rear portion to more fully illustrate a flexible duct connected to the exhaust filtering system worn by the doctor.

Referring now to FIGS. 2 and 3 there is shown doctor 10 illustrated in FIG. 1 wearing a sterile surgical gown 40 of the type covering his head and his complete body. The hands 42 are covered with surgical gloves 44 thereby insuring that all portions of the body are covered by sterile material. The sterile gown covers the complete body portion of the doctor 10 including the pressure filtering system 14 and the vacuum filtering system 32.

As shown in FIG. 3 the flexible duct 36 is attached to the vacuum filtering system 32 and extends to a position below the hem 50 on the sterile gown 40 but above the floor level. In this way the exhaust filtered air from the flexible duct 36 is directed into the clean room environment and is not trapped within the gown 40. Without the flexible duct 36, air being exhausted from filter 34 would recirculate and be drawn in filter 26 associated with the pressure filtering system 14. The recirculation increases the temperature of the air being directed to the helmet 24 on the doctor 10 and deprives the doctor of adequate oxygen thereby making the filtering system unusable when used with a full gown 40.

Figure 4:
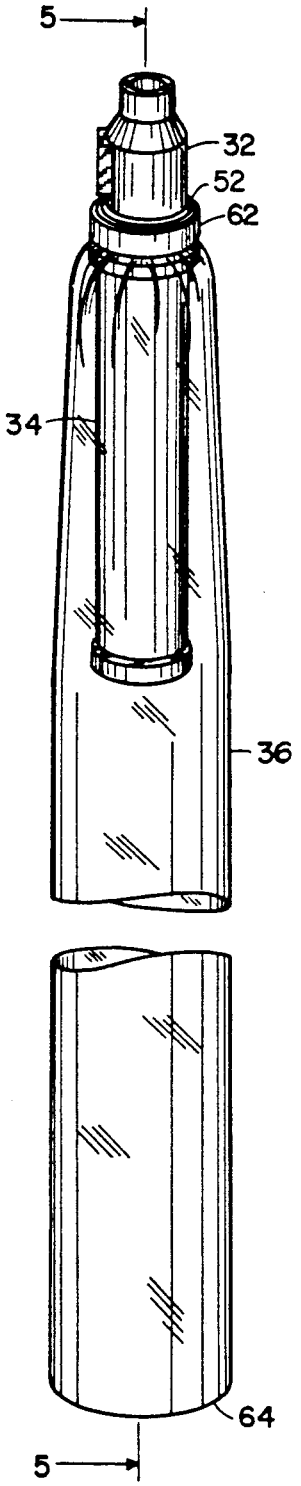
FIG. 4 is an assembly view illustrating how the flexible duct is attached to the exhaust filtering system.
Figure 5:
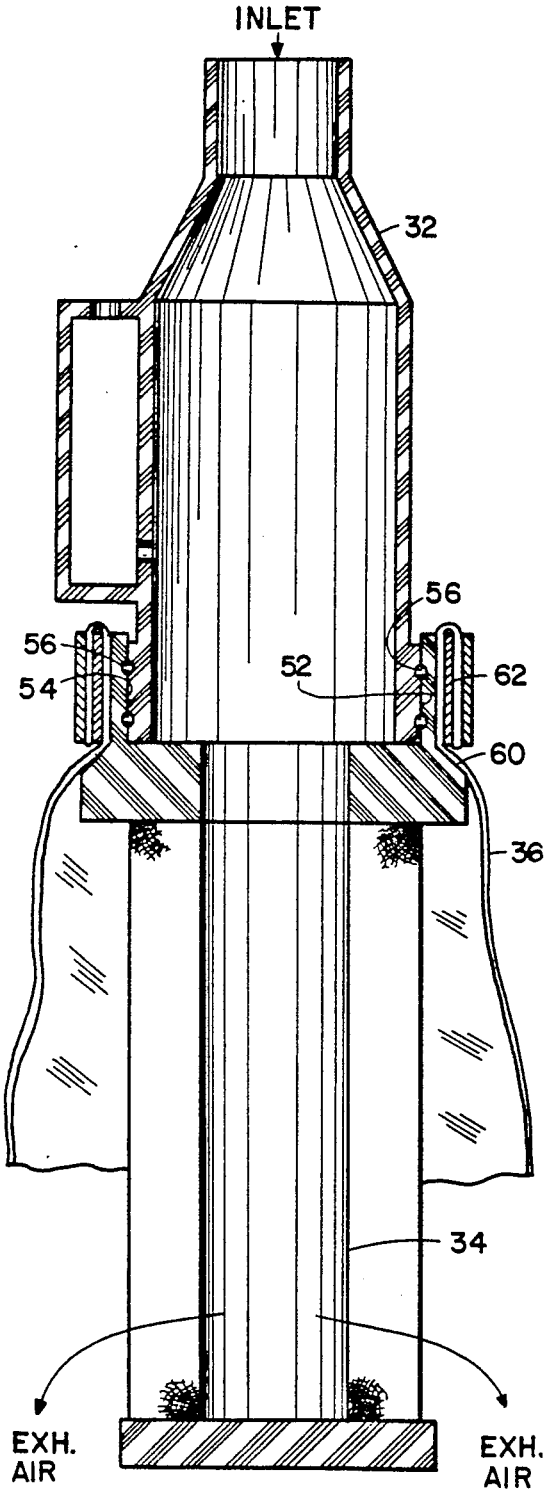
FIG. 5 is a cross sectional view taken along lines 5—5 of FIG. 4.

Referring now to FIGS. 4 and 5 there is shown in more detail how the flexible duct 36 is attached to the vacuum filtering motor 32. The assembly view shown in FIG. 4 shows the vacuum filtering system 32 contains a lip portion 52 at one end capable of being inserted into an opening 54 on filter 34 for attaching the filter 34 to the motor 32. A simple pressure fit with suitable O-Rings 56 insure a leak free fit between the filter 34 and the motor 32.

A shoulder portion 60 having a diameter greater then the diameter of opening 54 surrounds the opening and is used as a retainer for holding the flexible duct 36 in place.

Flexible duct 36 contains a ring 62 having an inside diameter large enough to pass over opening 54 but small enough to be restrained by the diameter of the shoulder 60. In operation, the filter 34 is inserted into the flexible duct 36 from the open end 64 until ring 62 is located over the opening 54 and abuts against shoulder 60. The filter 34 is then inserted into the motor 32 in a sealing relationship in the conventional manner.

The flexible duct 36 and the ring 62 are independent of the vacuum filtering system 32 thereby allowing the vacuum system to be used with or without the flexible duct 36.

We claim:

1. A clean room system including a sterile gown completely covering a pressure filtering system and a vacuum filtering system the improvement comprising:

a portable mobile pressure filtering system adapted to be carried by the user;

a portable mobile vacuum filtering system adapted to be carried by the user;

a sterile gown worn by the user and completely covering said pressure filtering system and said vacuum filtering system; and an exhaust system attached to the vacuum filtering system and adapted to exhaust air outside of said sterile gown thereby preventing any temperature increase resulting from exhaust air of said pressure filtering system in the air being supplied to the user.

2. A clean room system according to claim 1 which includes a flexible duct removably attached at one end to said vacuum filtering system and adapted to exhaust air outside of said sterile gown at the other end.

3. A clean room system according to claim 2 in which said gown has a hem portion and said flexible duct has a length extending to a point below said hem portion.

* * * * *